US005081798A

United States Patent [19]

Clasen

[11] Patent Number: 5,081,798

[45] Date of Patent: Jan. 21, 1992

[54] GRINDING BODY AND MANUFACTURING PROCEDURE THEREFOR

[76] Inventor: Heinrich Clasen, Gerstenbergstrasse 34, D-2060 Hamburg 52, Fed. Rep. of Germany

[21] Appl. No.: 477,967

[22] PCT Filed: Nov. 27, 1987

[86] PCT No.: PCT/DE87/00553

§ 371 Date: Jul. 26, 1990

§ 102(e) Date: Jul. 26, 1990

[87] PCT Pub. No.: WO89/04742

PCT Pub. Date: Jun. 1, 1989

[51] Int. Cl.[5] ..... B24B 55/06

[52] U.S. Cl. ..... 51/273; 51/362

[58] Field of Search ..... 51/394, 362, 406, 407, 51/DIG. 34, 273

[56] References Cited

U.S. PATENT DOCUMENTS 2,292,991 8/1942 Crompton, Jr. ..... 51/309
2,499,933 3/1950 Snul ..... 51/362
4,222,204 9/1980 Benner ..... 51/362
4,330,027 5/1982 Narasimban ..... 164/461
4,377,081 3/1983 Konrad ..... 69/6.5
4,941,245 7/1990 Yamashita et al. ..... 51/362

FOREIGN PATENT DOCUMENTS 316478 10/1956 Switzerland .
630549 6/1982 Switzerland .

*Primary Examiner*—M. Rachuba
*Attorney, Agent, or Firm*—David L. Davis

[57] ABSTRACT

A grinding foil comprising an abrasive medium on a flexible strip steel foil with a thickness of 0.05 to 0.25 mm and due to the properties of the strip steel foil has good thermal conductivity, thermal stability, tensile strength and selfadhesive properties on a permanently magnetic adhesive backing of a support member allowing fast-release attachment. Due to its ductility, fixing elements are produced in the foil at right angles to its surface and having the shape of inner flanges which engage in matching recesses in the support member, which further improves cooling and enables spot-accurate joining.

2 Claims, 1 Drawing Sheet

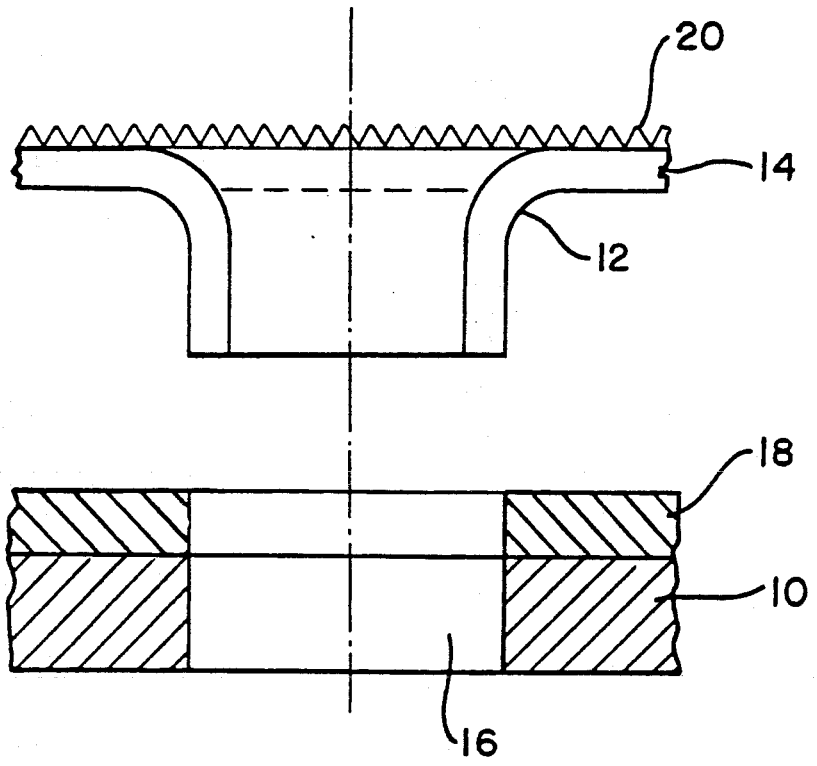
20
14
12
18
10
16

GRINDING BODY AND MANUFACTURING PROCEDURE THEREFOR

BACKGROUND OF THE INVENTION

A thermoplastic foil has become known (German Patent Application by Naxos Union, Frankfurt am Main, published on Oct. 16, 1950, page 495–504) and contrary to paper of fabric backings is intended to resist breaking, as the foil has no pores and the binding agent therefore cannot penetrate the foil. These thermoplastic foils have a thermal stability which is much too low for the intended application. Moreover, the usual abrasive medium backings also have poor thermal conductivity. The mechanical stability is seriously impaired by the poor thermal conductivity and therefore this often leads to premature destruction of the abrasive medium backing even before the abrasive coating has been sufficiently utilized. The clamped ends of the abrasive pads or disks or on pad sanders do tear particularly often as they need to be held very tight. There are arranged two expensive clamping means to hold a disk, the ends of which cannot be utilized in grinding. Abrasive disks constitute a permanent risk of accidents due to their liability to break, especially when the frequently interfering guard is removed. Low temperature grinding is often only possible by supplying a cooling emulsion.

A further grinding foil is known (U.S. Pat. No. 2,292,991—FLEXIBLE ABRASIVE PRODUCT) in which flexible metal foils are proposed as grinding medium backings, within the thickness range 0.0005 to 0.015 inches, or 0.025 to 0.375 mm. In line 33 of page 1, soft steel is named as the grinding medium backing material. The metal foils consist of soft metals with a coating of a soft metal serving as a binding means with a low melting point and which is caused to melt by the action of heat and is strewn with the abrasive material, and by means of rolling, part of the abrasive grains is embedded in the metal foil and part into the melt. However, there is no point in this patent document which says anything about attaching the grinding foil to a backing material.

Replacing abrasive disks on rotating disk supports by means of a quick-release attachment is enabled by the burr grip, described as early as 1959 in the monthly magazine "Popular Mechanics", March edition, volume 8, no. 3, page 28, as a means for securing clothing and upholstery: "Securing by means of nylon strips." Attachment of abrasive disks was shown for the first time at the Hanover Industrial Fair in 1987. One side of the grip is bonded to the abrasive disk, the other one to the support disk. When the abrasive is used up the paper is disposed of together with the fixing means making the abrasive paper rather expensive. Spot-accurate jointing is difficult, static electricity can hardly be leaked off and numerous small interspaces in the burr grip are very difficult to clean. Another disadvantage is the pressure required for joining. Sterilisation requires easy cleaning, so that application in food processing is practically out of question.

Abrasive surfacing or linings are used for peeling on vegetable and grain peeling machines. In the factory for manufacturing abrasive medium, an abrasive coating compound consisting of abrasive grains and binding agent is manually applied at a thickness of approx. 5–25 mm to the various peeling elements such as peeling plate, peeling drum and peeling segments, and hardened in an oven. This means that worn peeling elements always must be transported to the factory, which causes considerable costs. The necessity of having two peeling machines of the same design, for instance one for potatoes and one for carrots, is a disadvantage. Potatoes require a more coarse abresive surfacing. Repeated converting of the machine is too expensive.

SUMMARY OF THE INVENTION

The present invention relates to a grinding body with a grinding foil comprising an abrasive on a flexible abrasive backing and a support which has an adhesive area on its working surface, for firmly holding the grinding foil, characterized in, that the abrasive medium backing consists of a foil of strip steel having thickness of 0.05 to 0.25 mm, the foil of strip steel is provided with fixing elements, the adhesive backing is permanently magnetic and arranged at right-angles to the support surface, in the form of inner flanges of the foil, the support surface for accomodating the ring-shaped, tube-like inner flange collars is provided with matching blind and/or through holes also used as suction holes, whereby the inner flanges function as cooling elements and as covers between grinding foil and adhesive backing, as well as reliably preventing splinters and grinding dust from penetrating, and whereby the non-positive or force locked magnetic adhesion of the adhesive backing secures the grinding foil at its place by means of its magnetic forces acting at right-angles to the support surface, so that this magnetic adhesive forces together with the fixing elements locked in the holes provide for a force locked and a non-positive engagement between grinding foil and support.

A procedure for manufacturing a grinding body as described above by applying a fast release grinding foil to a support with an adhesive backing for securing to the grinding foil, is characterized by the fact that a foil having a thickness of 0.05 to 0.25 mm is coated with an abrasive medium, the foil is equipped with fixing elements in the shape of inner flanges by extending each of the holes in the foil to produce a ring-shaped and tube-like portion, the support is provided with a permanently magnetic adhesive backing and with recesses in line with the inner flanges of the foil, of strip steel, whereby the grinding foil is connected to the support in such a way that the inner flanges act as cooling elements and at the same time as covers between the grinding foil and the adhesive backing, and reliably prevent penetration of splinters and grinding dust, the force-locked magnetic adhesion of the adhesive backing secures the grinding foil at its place by means of its magnetic forces acting at right-angles to the support surface, so that this magnetic adhesive forces together with the fixing elements locked in the holes produce a force-locked non-positive engagement between the grinding foil and the support.

BRIEF DESCRIPTION OF THE DRAWING

The foregoing will be more readily apparent upon reading the following description in conjunction with the drawing in which the single FIGURE schematically depicts a portion of the grinding body of this invention.

DETAILED DESCRIPTION

A strip steel foil as flexible abrasive medium backing has all of the properties in order to avoid the disadvantages of conventional abrasive backing: These being good thermal conductivity, thermal stability and tear resistivity, felxibility and rigidity, plasticity, resistance to water and rotting, electrical conductivity for easy dissipation of static electricity.

Strip steel is known to be produced in very low thickness and it is common to denote strips having thicknesses between 0.025 and 0.25 mm as strip steel foil. Strip steel complying with DIN 1624/1544 was found to be a low cost and well suited strip steel, and strip steel foils made of this material are suitable as abrasive backing at thicknesses from 0.05 mm and more. (This is half the thickness of a page of thin typewriting paper). Strip steel with material number 1.4016 was found to be a suitable non-rusting material, manufactured at thicknesses starting from 0.07 mm, which due to its high price can be considered for special applications such as a backing for diamond grain.

Permanently magnetic foil is a practical, safe and inexpensive adhesive support on the support surface. Anisotropic magnetization gives it the greatest adhesive power, and at a thickness of 1.5 mm it will meet all of the requirements occurring during the grinding. The specific shaping of the grinding body means according to the invention reduces the magnetic foil thickness to 1 mm while enhancing the shear strength and cooling properties, and also enabling spot-accurate jointing to eliminate imbalance. This is achieved by providing the grinding foil 14 having abrasive material 20 with fixing elements arranged at right-angles. The support 10 for the grinding foils have matching recesses for these fixing elements. The preferred fixing elements have the shape of inner flanges 12 obtained by forming the strip steel foil 14 (to save material) by extending a hole in such a manner as to obtain a ring-shaped and tube-like part, i.e. the inner flange 12. The corresponding recess 16 in the support 10 is a blind or through hole. Two spaced inner flanges 12 result in a punctilious positioning of the grinding-foil when joining. Shear forces which occur during grinding can be absorbed depending upon material thickness and number of inner flanges. Those can be calculated as for hollow-type rivets, the shear strength can have high values even for thin strip steel foils. The prerequisite of use of magnetic foil 18 at thicknesses specified above is that a steel plate 10 approx. 0.2 mm thick is arranged beneath the foil and on an insulating plate (not shown) of at about 4 mm thickness, in order to obtain sufficient adhesive force. Some grinding machines have suction holes in the support to suck out debris. In this case the inner flange 12 and hole 16 arrangements in the magnetic foil 18, steel plate base 10 and insulating plate are lined up with the suction holes. This leads to the advantages that the inner flanges 12 reliably prevent grinding dust from penetrating between magnetic foil 18 and grinding foil 12.

As the shear forces during grinding increase with increasing grain size, the grinding foil strip steel backings are accordingly made thicker and thus having higher tensile strength: 0.05 to 0.25 mm thickness for very fine, fine medium and coarse grain.

Even without suction in the supports for grinding foils the through holes, especially in rotating grinding disks, assist is cooling by causing air turbulence.

Good thermal stability of the strip steel foil makes it expedient to use not only the usual phenolic and alkyd resins but other binding agents having higher thermal stability, too, such as powder coatings of epoxy and polyurethane resins and also organic-anorganic ormosiles, but also a ceramic bond such as molten glaze and enamel as used, for example, in the enamelling industry for continuous coating of strip steel. Here as in the abrasives industry coating is done in an electrostatic field so that instead of the sticky resin, the melt is coated with grains.

It is presently contemplated that the invention may best be practiced in the following ways:

1. The simplest way is to cover the strip steel foil with an abrasive on a flexible backing, as the abrsive factory is already equipped with all of the installations required for this.
2. Instead of abresive paper or fabric, strip steel foil is coated in the electrostatic field using well known procedure for example by means of alkyd resin as binding agent such as is used for waterproof abrasive papers.
3. To manufacture grinding foils with particularly high thermal stability, the binding agent powder—for example powder coating, ormosile powder, enamel frit powder—is applied electrostatically and melted and the grains are strewn electrostatically onto the coating of melt.

The grinding foil in the form of an abrasive paper laminate can increase commercial applicability. This kind of foil can be made self-adhesive, whereby it is less expensive to use thin papers. The flexibility, however, is greater for same foil thickness when the strip steel foil is coated directly. Grinding foils have a longer service life by being of considerably higher quality. They allow cooler grinding and a quicker replaceable abrasive surfacing in the form of self-adhesive grinding surfaces on supports fitted with permanently magnetic foils They allow cool grinding instead of use of grinding disks without guards, and without the risks of accidents caused by the breaking disks. They also allow secure attachments simply by positioning, even on vibrating grinders, so no elaborate clamping fixtures are required, and torn belt ends belong of the past. Furthermore there is no loss of abrasive material by having to clamp the ends of belts. Grinding becomes very cheap in comparison with grinding procedures requiring disks, which is due to the versatility of the system and the fact that no hardness grading is required as it is for grinding disks, making storage easier. Slots can be ground without risk—something which would be very dangerous using a grinding disk with the guard removed. The extremely wide range of applications and the possibility of cool and dry grinding, the easy and fast replacement, the reduced risk of accidents, the possibility of wet grinding while applying water or underwater grinding, for example for peeling vegetables and grinding stone, the possibility of having a single peeling machine instead of two, the possibility of ceramic bond for grinding foils, the possibility of total utilization of grinding foils by cutting up the used ones to use them on hand sanding blocks until they are fully used up, whereby inner flanges can be produced by hand, e.g. by punching with a drift punch on a piece of wood and extending the hole with the same drift punch to form the tube-shaped inner flange. For peeling machine drums there is the advantage that the flexible grinding foil automatically lies flat against the wall of the drum when the wall is lined with magnetic foil. This flexibility therefore allows adaptation to any drum radius. In comparison with the thick layer of abrasive on conventional peeling surfaces, the abrasive coating is much more open and therefore causes more intensive grinding action. Clogged up peeling surfaces of grinding foils can be removed in a simple step and can even be cleaned by boiling and sterilized which is even possible with alkyd resin bond. Even under water there is no reduction of adhesive force of the magnetic foil and there is not material fatigue whatsoever as there is in burr grips, which lose as much as 50% of their adhesive force.

I claim:

1. Grinding body with a grinding foil comprising an abrasive on a flexible abrasive backing and a support which has an adhesive area on its working surface, for firmly holding the grinding foil, characterized in that the abrasive backing consists of a foil of strip steel having thickness of 0.05 to 0.25 mm, the foil of strip steel is provided with fixing elements, the adhesive backing is permanently magnetic and arranged at right-angles to the support surface, the fixing elements are in the form of ring-shaped, tube-like inner flanges of said foil, and the support surface for accommodating the ring-shaped, tube-like inner flanges is provided with matching holes also used as suction holes, whereby the inner flanges function as cooling elements and as covers between the grinding foil and the adhesive backing, as well as reliably preventing splinters and grinding dust from penetrating between the grinding foil and the adhesive backing, and whereby the magnetic adhesion of the adhesive backing secures the grinding foil at its place by means of its magnetic forces acting at right-angles to the support surface, so that the magnetic adhesive forces together with the fixing elements locked in the holes provide for a force locked and a non-positive engagement between the grinding foil and the support.

2. Procedure for manufacturing a grinding body, comprising the steps of:

providing a strip steel foil having a thickness of 0.05 to 0.25 mm;

coating said foil with an abrasive medium;

equipping said foil with fixing elements in the shape of inner flanges by forming and extending holes in the foil to produce a ring-shaped and tube-like portion;

providing a steel support member having recesses aligned with the inner flanges of the foil; and providing a permanently magnetic adhesive backing on said support member having recesses aligned with the suppert member recesses;

whereby the grinding foil is connected to the support member in such a way that the inner flanges act as cooling elements and at the same time as covers between the grinding foil and the adhesive backing, and reliably prevent penetration of splinters and grinding dust therebetween, the force-locked magnetic adhesion of the adhesive backing secures the grinding foil at its place by means of its magnetic forces acting at right-angles to the support surface, so that these magnetic adhesive forces together with the fixing elements locked in the recesses produce a force-locked non-positive engagement between the grinding foil and the support member.

* * * * *